United States Patent [19]

Trelby

[11] Patent Number: 4,697,747

[45] Date of Patent: Oct. 6, 1987

[54] TUBE MILL

[75] Inventor: Ib V. Trelby, Copenhagen, Denmark

[73] Assignee: F. L. Smidth & Co. A/S, Copenhagen, Denmark

[21] Appl. No.: 796,636

[22] Filed: Nov. 8, 1985

[30] Foreign Application Priority Data

Dec. 4, 1984 [GB] United Kingdom ..... 8430514

[51] Int. Cl.[4] ..... B02C 17/24

[52] U.S. Cl. ..... 241/54; 241/70; 241/176; 241/180; 241/299

[58] Field of Search ..... 241/54, 70, 71, 72, 241/153, 179, 181, 182, 183, 176, 177, 178, 171, 172, 180, 101.2

[56] References Cited

U.S. PATENT DOCUMENTS 4,185,785 1/1980 Nelson ..... 241/171 X

FOREIGN PATENT DOCUMENTS 2005864 10/1980 Fed. Rep. of Germany ..... 241/179

313560 11/1971 U.S.S.R. ..... 241/179

*Primary Examiner*—Mark Rosenbaum

*Attorney, Agent, or Firm*—Brumbaugh, Graves, Donohue & Raymond

[57] ABSTRACT

A gas swept tube mill has a rotary shell (1) supported on a bearing (5) by a slide ring (3), which is reinforced by a stiffening web plate (4). Ground material and gas pass out of the mill shell through a sieve plate (10) and openings (8) in a frustoconical connecting section (12) into a stationary casing (9). The wider end of the section (12) is of similar diameter to the shell (1), to which it is fastened, and the narrower end of the section (12) is fastened to a drive shaft (7) for rotating the shell (1).

3 Claims, 4 Drawing Figures

TUBE MILL

The invention relates to gas swept tube mill for grinding particulate material, and comprising a cylindrical mill shell having, at an outlet end thereof, a ring, which is reinforced inside the mill shell by an annular stiffening web plate, and by which ring the mill is supported on at least one bearing; a connecting section connecting the mill shell with a drive shaft which is coaxial with, and is arranged to transmit rotation to, the mill shell, the connecting section being provided with openings for the discharge of ground material and gas.

In known tube mills of this kind, a sieve plate for separating and discharging finish ground material may be mounted on, and spaced from, the inboard side of the stiffening plate, while the connecting section may be fastened to the outboard side of the plate, the connecting section having the shape of a cylindrical drum projecting outwards from the mill shell end to a surrounding stationary housing for collecting and conveying away the discharged material and gas. A solid end plate closes the outward end of the connecting section and forms a mounting for the drive shaft.

In the space between the sieve plate and the stiffening plate is often mounted a scoop arrangement for transferring ground material, which has passed through the sieve plate, into the cylindrical drum.

The torque to be transmitted from the drive shaft through the connecting section to rotate the mill shell when grinding the material has to be comparatively large and the hitherto construction of the connecting section, and particularly its connection to the stiffening plate in the mill shell, has therefore been comparatively complicated and not particularly advantageous for transmitting the relatively large torque.

Thus it is the object of the invention to provide a tube mill of the kind described with a connecting section, which is simpler and more advantageous for transmitting the torque in question than the known mills, and this is achieved according to the invention in that the connecting section is a frustoconical drum, the larger diameter end of which has substantially the same diameter as that of the mill shell and is fastened thereto, while the smaller diameter end of the drum is connected to the drive shaft.

Via this frustoconical drum the torque is transmitted via the shortest possible and most direct way from the drive shaft to the mill shell proper.

Further, owing to the fact that the cross section of the larger diameter end of the drum is significantly larger than that of a cylindrical drum of the known kind serving the same purpose, and that the surface of the frustoconical drum is larger than the surface of the cylindrical drum and can therefore provide the possibility of mounting more outlet openings in the drum wall, a significant reduction of the pressure loss in the tube mill according to the invention may be achieved.

The frustoconical drum also makes it possible for the sieve plate, instead of being mounted inside the mill shell chamber proper where it reduces the interior space, to be mounted downstream of the stiffening plate, even in the drum, with the resulting constructional advantages for the mill in the form of an increased chamber length without increasing the total length of the mill.

Further, the frustoconical drum, the larger diameter end of which has substantially the same diameter as that of the mill, may make a scoop arrangement in the mill outlet, for conveying material into the section, superflous.

Finally, the stiffening web plate inside the mill shell for reinforcing the ring, can serve directly as dam ring in the mill chamber, thus obviating special constructional measures to provide such a dam ring.

The drum may be welded to the outboard edge of the ring, or may be bolted to the outboard side of the stiffening plate.

The invention will now be explained in more detail with reference to the accompanying drawings, in which.

Figure 1:
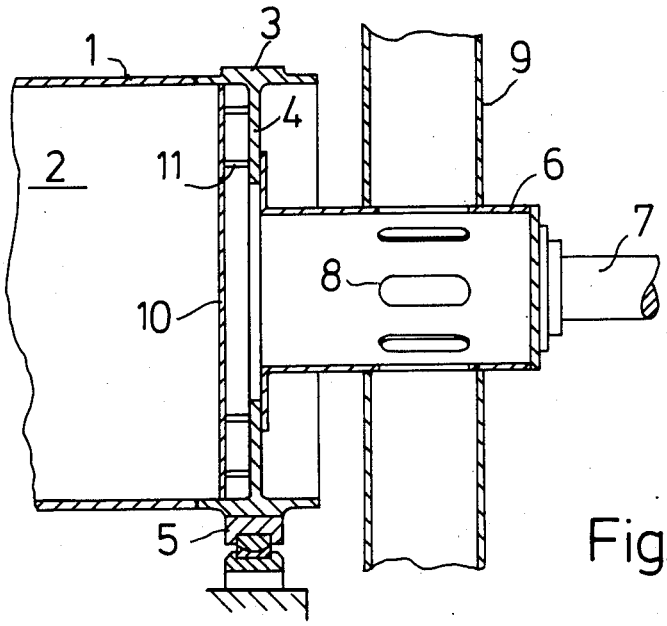
FIG. 1 is an axial section through the outlet end of a tube mill of known construction.

FIG. 1 shows a tube mill of known kind, comprising a mill shell 1 encasing a grinding chamber 2. The shell 1 has at its outlet end (to the right in the drawing) a slide ring 3 reinforced in the interior of the shell by an annular stiffening web plate 4. The slide ring 3 slides on a slide bearing arrangement 5, resting on the mill foundation.

The stiffening plate 4 projects into the mill shell, and onto its inner edges is mounted a cylindrical drum 6 constituting the connection between the mill shell 1 and a drive shaft 7, which is coaxial with the mill shell axis.

The drum 6 has openings 8 for the discharge of ground material and gas from the mill, and these openings lead to a surrounding stationary housing 9 for further conveying of material and gas away from the mill.

On the left side of the stiffening plate 4 is a sieve plate 10, which is fastened to the web plate 4 by means of distance pieces 11.

Material finish ground in the grinding chamber 2, to a size which can pass the sieve plate 10, flows through the latter to the space between the sieve plate 10 and the stiffening web plate 4 from where the material, by overflow, and possibly by means of scoops mounted in the space, flows out into the drum 6 and further on out of the openings 8 into the stationary housing 9. The gas, passed through the mill for drying and cooling, similarly flows through the sieve plate 10, the drum 6, the openings 8 and out into the stationary housing 9.

Figure 2:
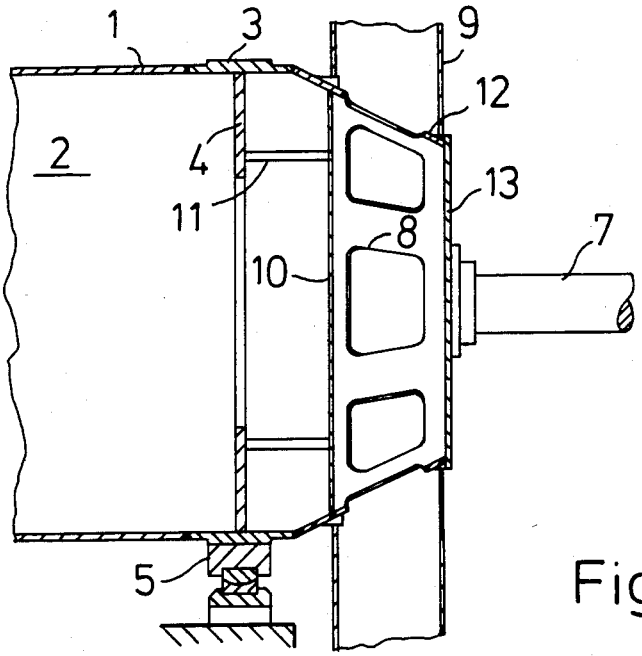
FIG. 2 is a corresponding section of a tube mill according to the invention.

FIG. 2 shows a mill with a connecting section 12 according to the invention.

The connecting section is constructed as a frustoconical drum 12 the largest diameter of which substantially corresponds to the mill diameter, and the drum 12 is, at this end, welded onto the mill shell 1, or to the one edge of the slide ring 3.

The drive shaft 7 may be mounted on an end plate 13 at the smaller diameter end of the conical drum 12.

The openings 8 are mounted in the frustoconical portion of the drum 12.

Comparison between the constructions shown in FIG. 1 and FIG. 2, shows that the frustoconical drum has a significantly simpler construction than the hitherto known construction, and is far better suited for directly transmitting the torque from the drive shaft 7 to the slide ring 3 and/or the mill shell 1.

Further, the frustoconical drum 12 has a significantly larger diameter, which means a correspondingly larger gas throughflow area, and further yields the possibility of providing more outlet openings 8, which may reduce the pressure loss in the mill in an advantageous way.

Finally, owing to the larger dimensions of the connecting section 12 it is possible to mount the sieve plate 10 as shown in FIG. 2 on the outboard side of the stiffening web plate 4, in relation to the grinding chamber 2, so that the stiffening plate can be used directly as a dam ring and the mill chamber may thus be correspondingly better utilized.

Figure 3:
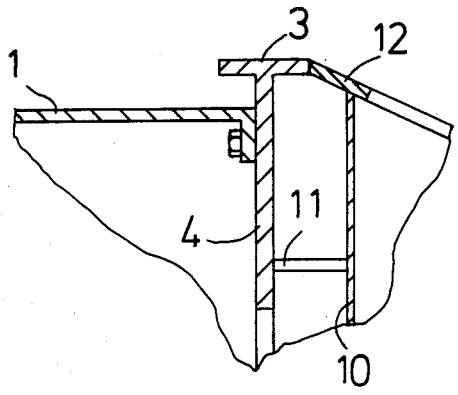
FIG. 3 is a detail of an assembly of the mill shell and its connecting section; and, FIG. 4 is a detail of a further such assembly.
Figure 4:
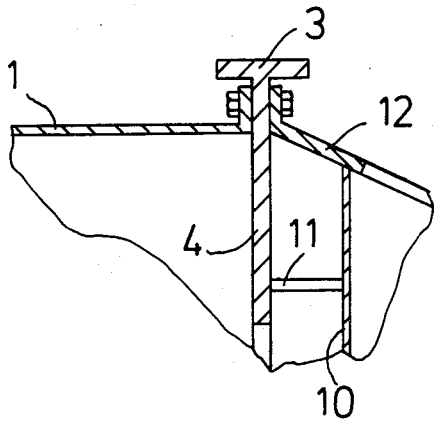

FIGS. 3 and 4 show a slide ring 3 with a somewhat larger diameter than that of the mill shell 1 proper. In this case the frustoconical drum may either be welded onto the slide ring 3 as indicated in FIG. 3 or be bolted onto the stiffening plate 4 of the latter, as indicated in FIG. 4.

What is claimed is:

1. In a gas swept tube mill for grinding particulate material, said mill comprising a cylindrical mill shell having, at an outlet end thereof, a ring, which is reinforced inside said mill shell by an annular stiffening web plate, and by which ring the mill is supported on at least one bearing; a connecting section connecting the mill shell with a drive shaft which is coaxial, with and is adapted to transmit rotation to, said mill shell, said connecting section being provided with openings for the discharge of ground material and gas, the improvement wherein said connecting section is a frustoconical drum with opposed larger and smaller diameter ends, said larger diameter end having substantially the same diameter as that of said mill shell; means fastening said larger diameter end to said mill shell and means connecting said smaller diameter end to said drive shaft, and a sieve plate mounted downstream of said stiffening web plate.

2. A mill according to claim 1, wherein said drum is welded to an outboard edge of said ring.

3. A mill according to claim 1, wherein said drum is bolted to the outboard side of said stiffening plate.

* * * * *